US010562660B2

(12) United States Patent
Vasbinder

(10) Patent No.: US 10,562,660 B2
(45) Date of Patent: Feb. 18, 2020

(54) CRATE WITH STACKING LEDGE AND BLANK THEREFOR

(71) Applicant: WestRock Shared Services, LLC, Norcross, GA (US)

(72) Inventor: Eric L. Vasbinder, Mableton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 53 days.

(21) Appl. No.: 15/615,409

(22) Filed: Jun. 6, 2017

(65) Prior Publication Data

US 2018/0346178 A1 Dec. 6, 2018

(51) Int. Cl.

| | |
|---|---|
| ***B65D 5/00*** | (2006.01) |
| ***B65D 5/42*** | (2006.01) |
| *B65D 5/02* | (2006.01) |

(52) U.S. Cl.

CPC ..... *B65D 5/0015* (2013.01); *B65D 5/003* (2013.01); *B65D 5/42* (2013.01); *B65D 5/02* (2013.01)

(58) Field of Classification Search

CPC ..... B65D 5/0015; B65D 5/42; B65D 5/0035; B65D 5/22; B65D 5/003; B65D 5/2004; B65D 5/2009; B65D 5/443; B65D 5/001

USPC ..... 229/190, 915, 919, 167, 169, 114, 150, 229/168, 117.16, 117.09, 122.32; 206/518, 519; 493/136, 89

See application file for complete search history.

(56) References Cited

U.S. PATENT DOCUMENTS

| | | | | | |
|---|---|---|---|---|---|
| 3,580,475 | A * | 5/1971 | Mobley | B65D 5/0035 | 206/509 |
| 3,910,484 | A * | 10/1975 | Wozniacki | B65D 5/2047 | 229/171 |
| 4,770,339 | A * | 9/1988 | Weimer | B65D 5/0045 | 206/509 |
| 5,458,283 | A * | 10/1995 | Southwell | B65D 5/0025 | 229/178 |
| 5,494,214 | A * | 2/1996 | Fleury | B65D 5/6664 | 229/114 |
| 5,535,942 | A * | 7/1996 | Vilona | B65D 5/0035 | 229/122.32 |
| 6,029,886 | A * | 2/2000 | Sheffer | B65D 5/0035 | 229/167 |
| 6,116,498 | A * | 9/2000 | Sheffer | B65D 5/0035 | 229/114 |
| 6,938,820 | B2 * | 9/2005 | Noone | B65D 5/0015 | 229/176 |

* cited by examiner

*Primary Examiner* — Christopher R Demeree
(74) *Attorney, Agent, or Firm* — WestRock IP Legal

(57) ABSTRACT

A container formed from a blank of sheet material includes a bottom wall, first and second end walls, and first and second side walls. The first and second end walls each include, in series, an end wall panel, a ledge panel that extends inwardly from an upper edge of the end wall, an angled support panel that extends diagonally toward the end wall panel, and an anchor panel in facing contact with the end wall panel. The ledge panel, angled support panel, and end wall panel form a triangular cross-section. The side walls each include first and second wrap-around flaps that extend from respective end edges of the side walls and at least partly around a corresponding one of the container's first and second end walls.

10 Claims, 12 Drawing Sheets

CRATE WITH STACKING LEDGE AND BLANK THEREFOR

BACKGROUND

The field of the invention relates generally to a crate and a blank for forming the crate, and more particularly to a crate having a stacking ledge.

Reusable plastic crates (RPCs) are widely-used in the grocery industry for transporting, storing, and distributing foods such as fresh fruits and vegetables. Advantages of RPCs include a stackable interlocking design, a "display ready" design that can significantly reduce stocking time, and a foldable design that reduces storage space and transport costs by allowing the containers to be folded when not in use. Disadvantages of RPCs include the risk of loss / theft and a relatively high cost resulting from the need to wash and sanitize the RPCs after each use and transport them to a facility for that purpose.

More recently, single-use, corrugated alternatives to RPCs have been used. A disadvantage of most such crates is that they may be difficult to stack or may lack adequate stacking strength. Accordingly it is an object of at least one aspect of the present invention to provide a crate that solves or mitigates the problems associated with the prior art.

SUMMARY

According to a first aspect of the invention, there is provided a container formed from a blank of sheet material. The container includes a bottom wall having two opposing end edges and two opposing side edges extending between the end edges. The container also includes first and second end walls that each include, in series, an end wall panel extending upwardly from a corresponding one of the bottom wall end edges, a ledge panel extending inwardly from an upper edge of the end wall panel, an angled support panel extending diagonally toward the end wall panel, and an anchor panel in facing contact with the end wall panel. The ledge panel, angled support panel, and end wall panel form a triangular cross-section. The container also includes first and second side walls extending upwardly from respective bottom wall side edges. Each of the first and second side walls includes a first wrap-around end flap extending from a first side wall end edge and at least partly around the first end wall, and a second wrap-around end flap extending from a second side wall end edge and at least partly around the second end wall. The first wrap-around end flap extends above the ledge panel of the first end wall, and the second wrap-around end flap extends above the ledge panel of the second end wall.

Optionally, each of the first and second side walls include an inner side panel and an outer side panel secured in facing contact with one another.

Optionally, each of the first and second wrap-around end flaps includes an inner end flap and an outer end flap secured in facing contact with one another. The inner end flap extends from a side edge of the inner side panel and the outer end flap extends from a side edge of the outer side panel.

Optionally, at least one of the first and second wrap-around end flaps of at least one of the first and second side walls defines a first handle cutout.

Optionally, the end wall panel of at least one of the first and second end walls defines a second handle cutout, and the anchor panel of the at least one of the first and second end walls defines a third handle cutout. The first, second, and third handle cutouts align with one another to form an end handle.

Optionally, the anchor panel is configured to extend from the angled support panel to at a point that is at or adjacent to the bottom wall.

Optionally, the ledge panel is substantially perpendicular to the end wall panel.

Optionally, each of the first and second end walls includes a handle that does not extend completely through the respective end wall.

According to a second aspect of the invention, there is provided a container formed from a blank of sheet material. The container includes a bottom wall, two opposed side walls each extending from the bottom wall, and two opposed end walls each extending from the bottom wall. At least a first of the two opposed end walls includes an outer ply, a middle ply, and an inner ply. The container further includes a stacking ledge extending between the middle ply and the inner ply. The stacking ledge extends at least partially between the two side walls.

Optionally, the container further includes a second stacking ledge disposed at a second of the two opposed end walls.

Optionally, the outer ply extends above the stacking ledge.

Optionally, each of the two opposed side walls includes first and second side panels secured together in facing contact.

Optionally, the outer ply includes first and second wrap-around end flaps. The first wrap-around end flap extends from an end edge of a first of the two side walls and at least partly around said at least first end wall, and the second wrap-around end flap extends from an end edge of a second of the two side walls and at least partly around the at least first end wall.

Optionally, the at least first end wall includes a handle that extends at least partially through the at least first end wall.

Optionally, the handle does not extend completely through the at least first end wall and into an interior of the container.

Optionally, the stacking ledge is substantially perpendicular to the at least first end wall.

According to a third aspect of the invention, there is provided a blank for forming a container. The blank includes a bottom wall panel having two opposing end edges and two opposing side edges extending between the end edges. The bottom wall panel is configured to form a bottom wall in a set-up container. The blank further includes a first plurality of panels configured to form a first end wall in the set-up container. The first plurality of panels are hingedly connected to one another and include, in series: a first end wall panel, a first ledge panel, a first angled support panel, and a first anchor panel. The first end wall panel is hingedly connected to the bottom wall panel at a first of the opposing end edges. The first end wall panel is configured to extend upwardly from the first of the opposing end edges in the set-up container. The first ledge panel is configured to extend inwardly from an upper edge of the first end wall panel in the set-up container and thereby form a first stacking ledge. The first angled support panel is configured to extend diagonally toward the first end wall panel in the set-up container. The first anchor panel is configured to be positioned in facing contact with an interior surface of the first end wall panel in the set-up container. The first ledge panel, first angled support panel, and first end wall panel form a triangular cross-section in the set-up container. The blank further includes a first side wall panel configured to form a first side wall in the set-up container and a second side wall panel configured to form a second opposed side wall in the set-up container. The first side wall panel is hingedly connected to the bottom wall panel at a first of the two opposing side edges and the second side wall panel is hingedly connected to the bottom wall panel at a second of the two opposing side edges. The blank further includes a first wrap-around end flap extending from a first end edge of the first side wall panel. The first wrap-around end flap is configured to extend at least partly around the first end wall in the set-up container. The blank further includes a second wrap-around end flap extending from a first end edge of the second side wall panel. The second wrap-around end flap is configured to extend at least partly around the first end wall in the set-up container. The first and second wrap-around end flaps are configured to extend above the first stacking ledge in the set-up container.

Optionally, the blank further includes a second plurality of panels configured to form a second end wall in the set-up container. The second plurality of panels are hingedly connected to one another and include, in series: a second end wall panel, a second ledge panel, a second angled support panel, and a second anchor panel. The second end wall panel is hingedly connected to the bottom wall panel at a second of the opposing end edges. The second end wall panel is configured to extend upwardly from the second of the opposing end edges in the set-up container. The second ledge panel is configured to extend inwardly from an upper edge of the second end wall panel in the set-up container and thereby form a second stacking ledge. The second angled support panel is configured to extend diagonally toward the second end wall panel in the set-up container. The second anchor panel is configured to be positioned in facing contact with an interior surface of the second end wall panel in the set-up container. The second ledge panel, second angled support panel, and second end wall panel form a triangular cross-section in the set-up container. The blank further includes a third wrap-around end flap extending from a second end edge of the first side wall panel. The third wrap-around end flap is configured to extend at least partly around the second end wall in the set-up container. The blank further include a fourth wrap-around end flap extending from a second end edge of the second side wall panel. The second wrap-around end flap is configured to extend at least partly around the second end wall in the set-up container. The third and fourth wrap-around end flaps are configured to extend above the second stacking ledge in the set-up container.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION

Detailed descriptions of specific embodiments of crates and blanks are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the crates and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "crate" or "carton" refers, for the non-limiting purpose of illustrating the various features of the invention, to a container for transporting, storing, and/or dispensing articles, such as, e.g., fresh produce or baked goods. However, it is contemplated that the teachings of the invention can be applied to various containers suitable for carrying a wide variety of articles.

Figure 1:
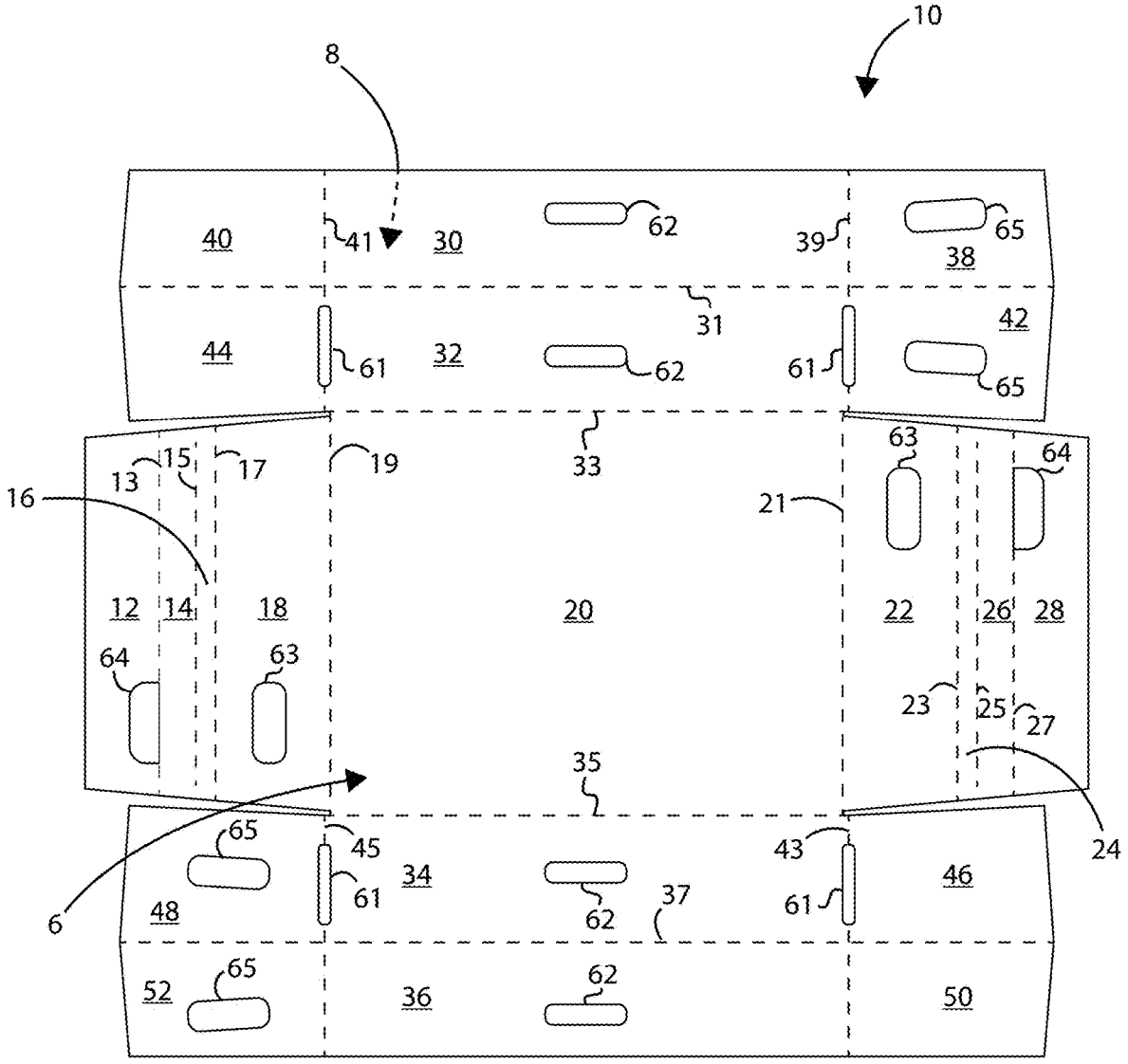
FIG. 1 is a top plan view of an exemplary blank of sheet material according to a first embodiment of the invention.

Referring to FIG. 1, there is shown a first blank 10 for forming a crate or carton 90 (see FIGS. 2-6). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the crates described in more detail below.

In one or more embodiments, blank 10 can be formed from a paperboard, corrugated board, or cardboard in which one or both sides of the blank, is printed and/or treated with one or more coatings, such as for example, one or more waterproof coatings and/or one or more coatings designed to provide a smooth and/or visually-attractive surface (e.g., a white or other colored surface). In one or more embodiments, informational or promotional material such as, e.g., a brand name or logo, can be printed on a treated side.

Referring to FIG. 1, blank 10 is generally rectangular in shape and has a first or interior surface 6 and a second or exterior surface 8. Blank 10 is generally symmetrical about central longitudinal and transverse axes. Blank 10 includes a plurality of panels 12, 14, 16, 18, 20, 22, 24, 26, and 28 hinged together in a longitudinal linear series. In addition, blank 10 includes a plurality of panels 30, 32, 34, and 36 that are, together with bottom panel 20, hinged together in a transverse linear series. End flaps 38, 40, 42, 44, 46, 48, 50, 52 are hingedly connected at respective ends of a corresponding one of the side panels 30, 32, 34, 36. In a set-up condition, the crate 90 forms an open-topped structure having a base or bottom wall, first and second side walls, and first and second end walls. A ledge or shelf structure extends inwardly from each of the first and second end walls.

The blank 10 includes a first anchor panel 12 hinged to a first angled support panel 14 via a transverse fold line 13. First angled support panel 14 is hinged to a first ledge panel 16 via a transverse fold line 15. First ledge panel 16 is hinged to a first end wall panel 18 via a transverse fold line 17. First end wall panel 18 is hinged to bottom panel 20 via a transverse fold line 19. Bottom panel 20 is hinged to a second end wall panel 22 via a transverse fold line 21. Second end wall panel 22 is hinged to a second ledge panel 24 via a transverse fold line 23. Second ledge panel 24 is hinged to a second angled support panel 26 via a transverse fold line 25. Second angled support panel 26 is hinged to a second anchor panel 28 via a transverse fold line 27.

The blank 10 also includes a first outer side panel 30 hinged to a first inner side panel 32 via a longitudinal fold line 31. First inner side panel 32 is hinged to bottom panel 20 via a longitudinal fold line 33. Bottom panel 20 is hinged to second inner side panel 34 via a longitudinal fold line 35. Second inner side panel 34 is hinged to second outer side panel 36 via a longitudinal fold line 37.

First outer side panel 30 is hinged, at a first end thereof, to a first outer end flap 38 via a transverse fold line 39, and, at an opposing second end thereof, to a second outer end flap 40 via a transverse fold line 41. In the illustrated first embodiment, transverse fold line 39 is generally aligned with, but slightly offset from, transverse fold line 21. Similarly, transverse fold line 41 is generally aligned with, but slightly offset from, transverse fold line 19. First inner side panel 32 is hinged, at a first end thereof, to a first inner end flap 42 via transverse fold line 39, and, at an opposing second end thereof, to a second outer end flap 44 via transverse fold line 41. First outer end flap 38 and first inner end flap 42 are also hingedly connected to one another along longitudinal fold line 31. Similarly, second outer end flap 40 and second inner end flap 44 are hingedly connected to one another along longitudinal fold line 31.

Second inner side panel 34 is hinged, at a first end thereof, to a third inner end flap 46 via a transverse fold line 43, and, at an opposing second end thereof, to a fourth inner end flap 48 via a transverse fold line 45. In the illustrated embodiment, transverse fold line 43 is generally aligned with but slightly offset from, transverse fold line 21. Similarly, transverse fold line 45 is generally aligned with, but slightly offset from, transverse fold line 19. Second outer side panel 36 is hinged, at a first end thereof, to a third outer end flap 50, and, at an opposing second end thereof, to a fourth outer end flap 52 via transverse fold line 45. Third inner end flap 46 and third outer end flap 50 are also hingedly connected to one another along longitudinal fold line 37. Similarly, fourth inner end flap 48 and fourth outer end flap 52 are hingedly connected to one another along longitudinal fold line 37.

Blank 10 also includes four inner end flap apertures 61. Each of the inner end flap apertures 61 has a generally elongated rectangular shape. A first inner end flap aperture 61 is disposed along a length of, and interrupts, the portion of fold line 39 that extends between first inner side panel 32 and first inner end flap 42. A second inner end flap aperture 61 is disposed along a length of, and interrupts, the portion of fold line 41 that extends between first inner side panel 32 and second inner end flap 44. A third inner end flap aperture 61 is disposed along a length of, and interrupts, the portion of fold line 43 that extends between second side panel 34 and third inner side panel 46. A fourth inner end flap aperture 61 is disposed along a length of, and interrupts, the portion of fold line 45 that extends between second side panel 34 and fourth inner end flap 48. Inner end flap apertures 61 are disposed such that the apertures extend into both their respective inner end flaps 42, 44, 46, 48 and a respective one of first and second inner side panels 32, 34. Inner end flap apertures 61 may facilitate the overlapping folding arrangement of inner and outer end flaps by removing some volume from the folded edges of the inner end flaps.

First inner side panel 32, first outer side panel 30, second inner side panel 34, and second outer side panel 36 each include a side handle cutout 62. In the illustrated first embodiment, cutouts 62 have a generally rounded rectangular shape. When the crate is in the setup condition, cutouts 62 of the first and second inner side panels 32, 34 are configured to align with and overlap respective cutouts 62 of the first and second outer side panels 30, 36 when the crate to form side handle structures 71.

First end wall panel 18 and second end wall panel 22 each include an end handle cutout 63. First anchor panel 12 and second anchor panel 28 each include an end handle cutout 64. First outer end flap 38 and first inner end flap 42 each include an end handle cutout 65. Fourth outer end flap 52 and fourth inner end flap 48 each include an end handle cutout 65. In the illustrated embodiment, end handle cutouts 63, 64, and 65 have a generally rounded rectangular shape. When the crate is in the setup condition, cutouts 63 of the first and second end wall panels 18, 22 are configured to align with and overlap respective cutouts 64 of the first and second anchor panels 12, 28, and also to align with and overlap respective cutouts 65 of the first inner and outer end flaps 38, 42 and fourth inner and outer end flaps 48, 52 to form end handle structures 72

Figure 2:
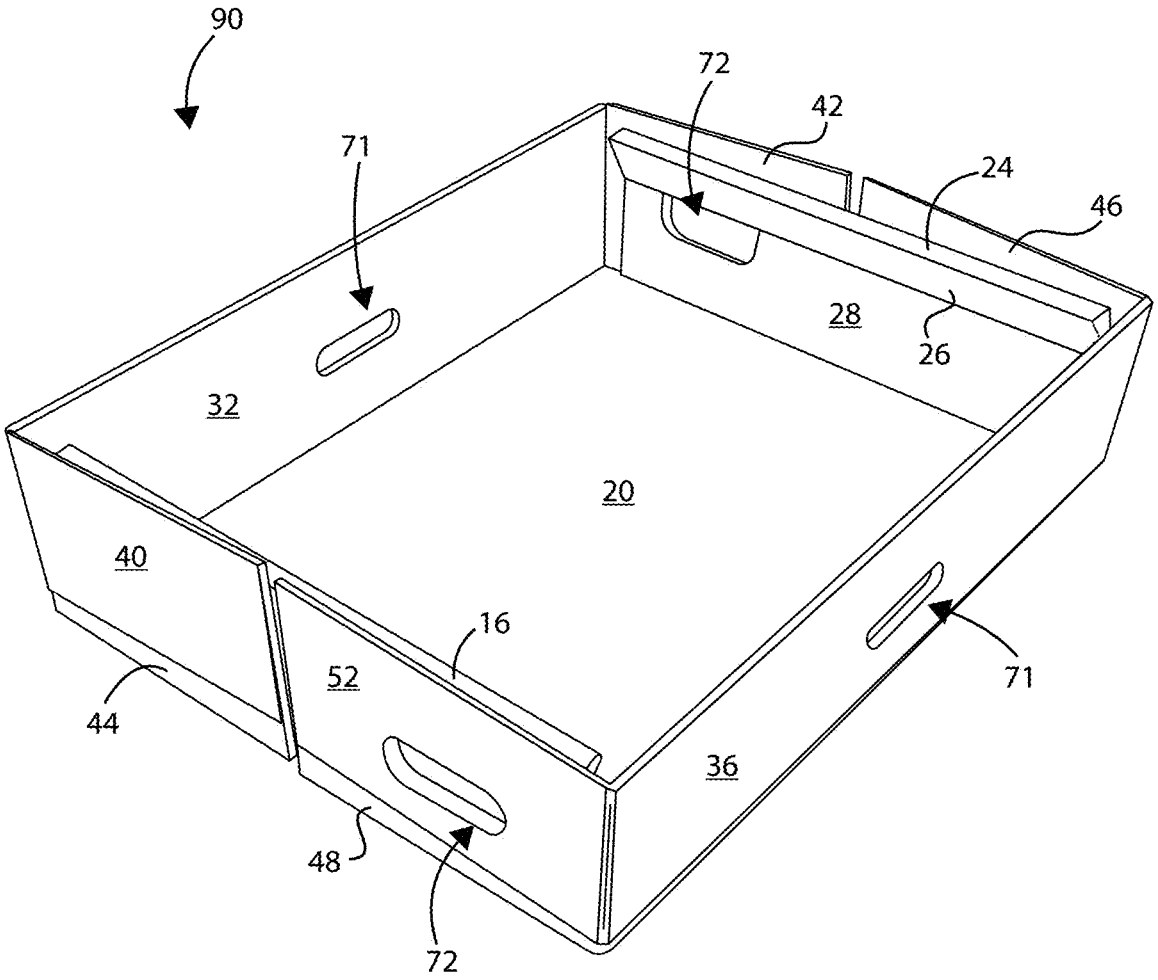
FIG. 2 is a perspective view of a container formed from the blank shown in FIG. 1.
Figure 3:
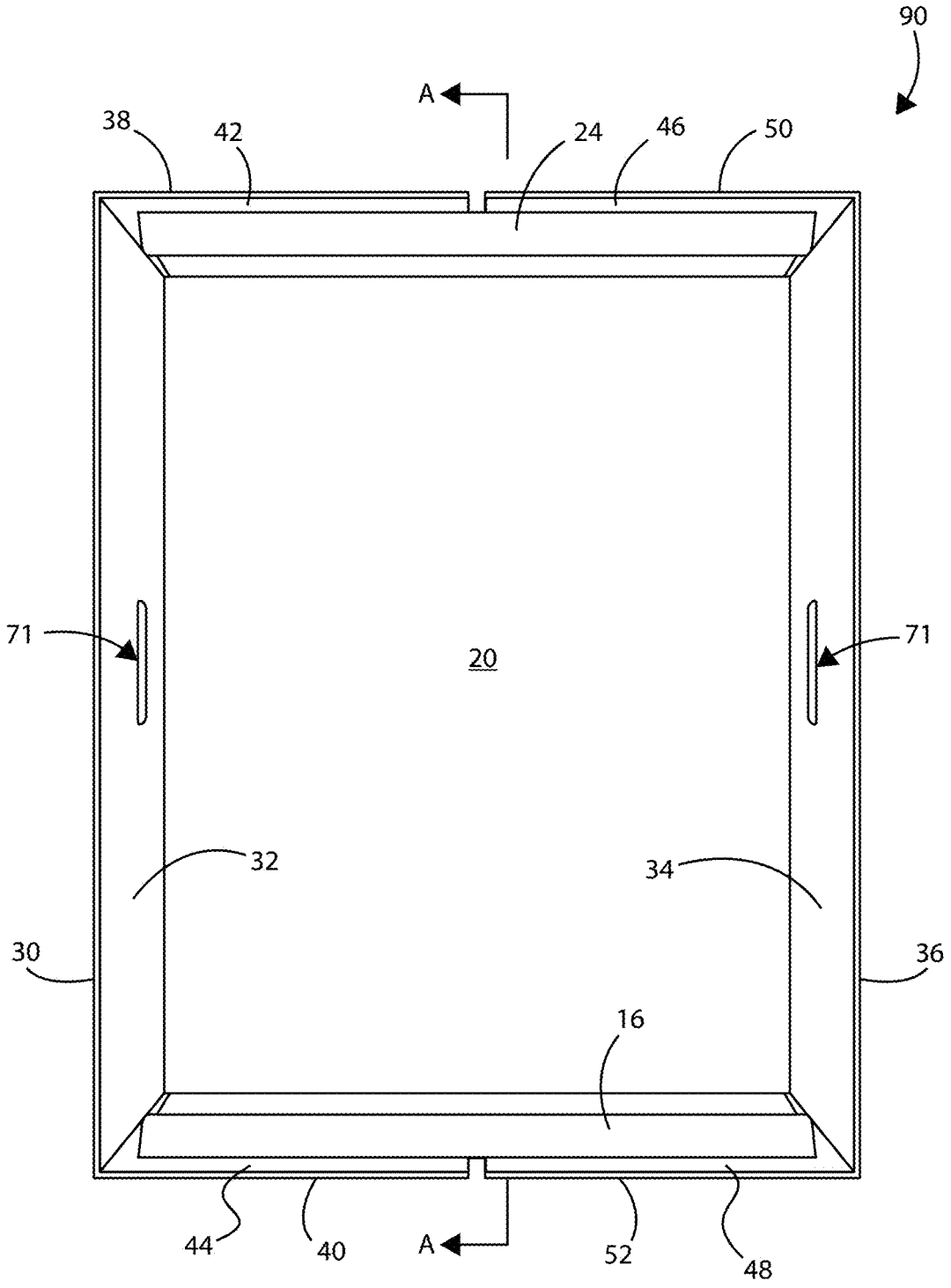
FIG. 3 is a top view of the container shown in FIG. 2.
Figure 4:
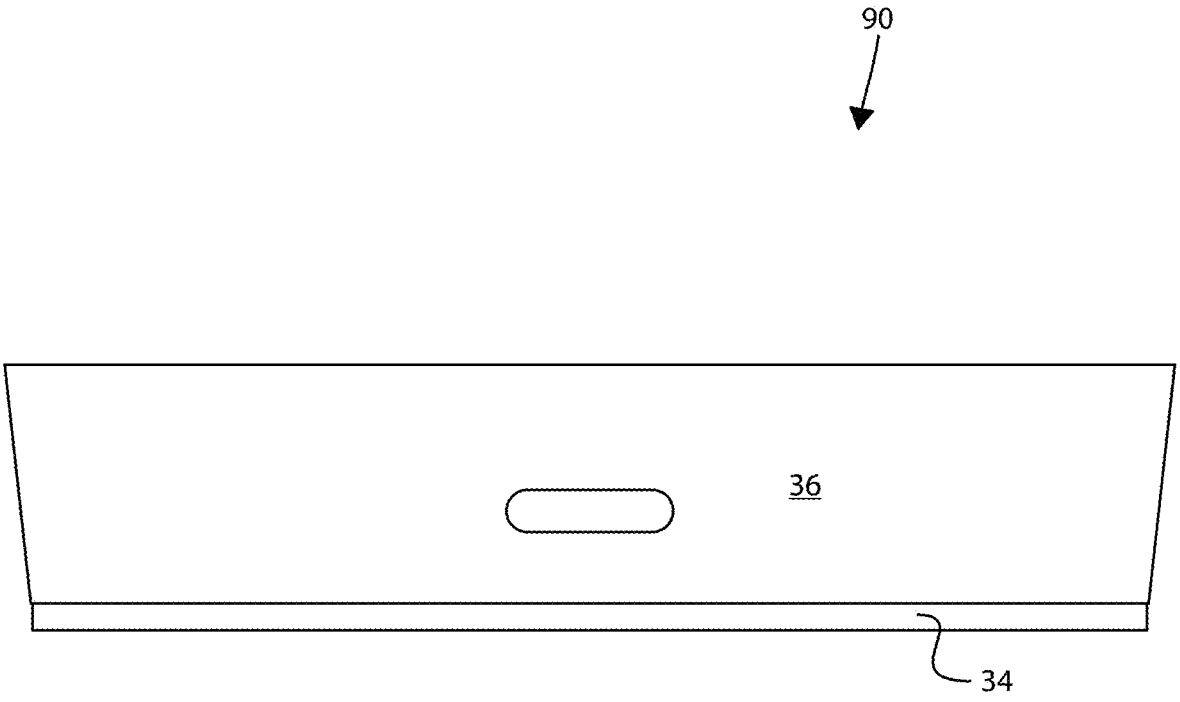
FIG. 4 is a side view of the container shown in FIG. 3.
Figure 5:
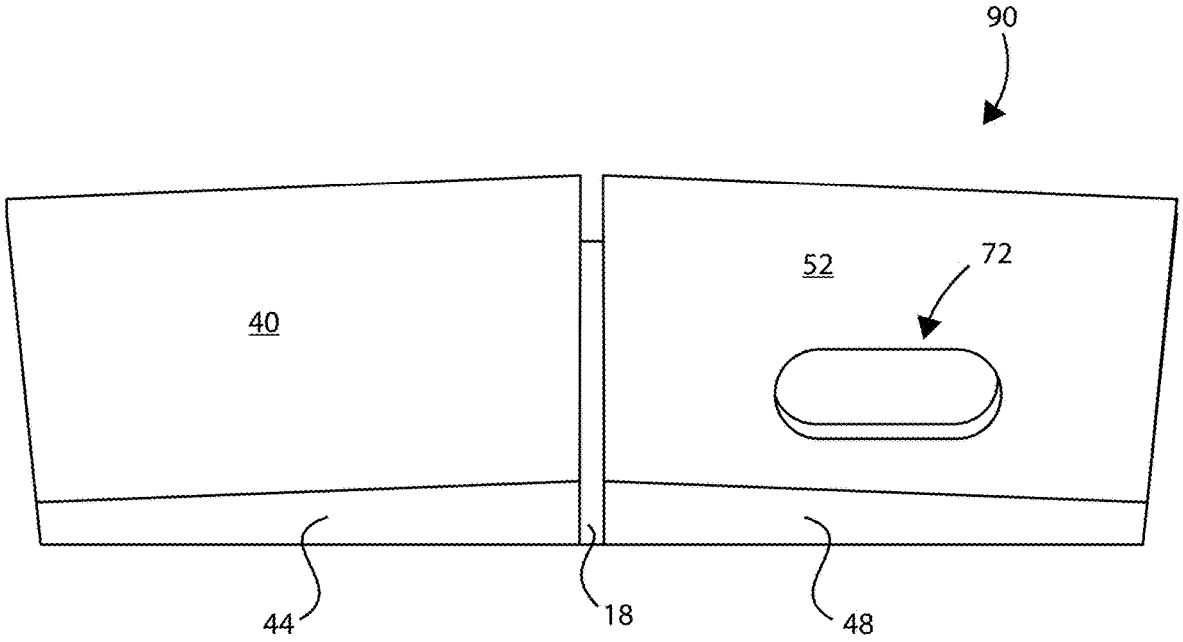
FIG. 5 is an end view of the container shown in FIG. 2.

Turning to the construction of the crate 90 as illustrated in FIG. 2, the crate 90 can be formed by a series of sequential folding operations. The folding process is not limited to that described below and may be altered according to particular manufacturing requirements.

Blank 10 is positioned with its interior surface 6 facing up as shown in FIG. 1. Glue or other adhesive treatment can be applied to the interior surface 6 of first anchor panel 12 or, alternatively, to the interior surface 6 of a corresponding portion of first end wall panel 18. First end wall panel 18 is rotated inwardly about fold line 19 toward interior surface 6 of bottom panel 20 into a substantially perpendicular relationship with bottom panel 20. First ledge panel 16 is rotated inwardly about fold line 17 toward interior surface 6 of first end wall panel 18 into a substantially parallel relationship with bottom panel 20. First angled support panel 14 is rotated inwardly about fold line 15 toward interior surface 6 of first ledge panel 16 while first anchor panel 12 is rotated outwardly about fold line 13 toward exterior surface 8 of first angled support panel 14. The interior surface 6 of first anchor panel 12 is brought into a face-contacting relationship with the interior surface 6 of first end wall panel 18 and secured thereto.

Similarly, glue or other adhesive treatment can be applied to the interior surface 6 of second anchor panel 28 or, alternatively, to the interior surface 6 of a corresponding portion of second end wall panel 22. Second end wall panel 22 is then rotated inwardly about fold line 21 toward interior surface 6 of bottom panel 20 into a substantially perpendicular relationship with bottom panel 20. Second ledge panel 24 is rotated inwardly about fold line 23 toward interior surface 6 of second end wall panel 22 into a substantially parallel relationship with bottom panel 20. Second angled support panel 26 is rotated inwardly about fold line 25 toward interior surface 6 of second ledge panel 24 while second anchor panel 28 is rotated outwardly about fold line 27 toward exterior surface 8 of second angled support panel 26. The interior surface 6 of second anchor panel 28 is brought into a face-contacting relationship with the interior surface 6 of second end wall panel 22 and secured thereto.

First inner side panel 32 is rotated inwardly about fold line 33 toward the interior surface 6 of bottom panel 20 into a substantially perpendicular relationship with bottom panel 20. Glue or other adhesive treatment can be applied to the exterior surface 8 of first inner side panel 32, first inner end flap 42, and second inner end flap 44, or, alternatively, to the exterior surface 8 of first outer side panel 30, first outer end flap 38, and second outer end flap 40. First outer side panel 30, first outer end flap 38, and second outer end flap 40 are then rotated outwardly about fold line 31 toward exterior surface 8 of respective first inner side panel 32, first inner end flap 42, and second inner end flap 44, bringing the corresponding inner and outer panels and flaps into a face-contacting relationship and securing them together.

Similarly, second inner side panel 34 is rotated inwardly about fold line 35 toward the interior surface 6 of bottom panel 20 into a substantially perpendicular relationship with bottom panel 20. Glue or other adhesive treatment can be applied to the exterior surface 8 of second inner side panel 34, third inner end flap 46, and fourth inner end flap 48, or, alternatively, to the exterior surface 8 of second outer side panel 36, third outer end flap 50, and fourth outer end flap 52. Second outer side panel 36, third outer end flap 50, and fourth outer end flap 52 are then rotated outwardly about fold line 37 toward exterior surface 8 of respective second inner side panel 34, third inner end flap 46, and fourth inner end flap 48, bringing the corresponding inner and outer panels and flaps into a face-contacting relationship and securing them together.

Glue or other adhesive treatment can be applied to the interior surface 6 of first inner end flap 42, or, alternatively, to a corresponding portion of the exterior surface 8 of second end wall panel 22. First inner end flap 42 (together with first outer end flap 38) is folded inwardly about fold line 39, bringing the interior surface 6 of first inner end flap 42 into face-contacting relationship with a corresponding portion of the exterior surface 8 of second end wall panel 22 and securing it thereto.

Glue or other adhesive treatment can be applied to the interior surface 6 of second inner end flap 44, or, alternatively, to a corresponding portion of the exterior surface 8 of first end wall panel 18. Second inner end flap 44 (together with second outer end flap 40) is folded inwardly about fold line 41, bringing the interior surface 6 of second inner end flap 44 into face-contacting relationship with a corresponding portion of the exterior surface 8 of first end wall panel 18 and securing it thereto.

Glue or other adhesive treatment can be applied to the interior surface 6 of third inner end flap 46, or, alternatively, to a corresponding portion of the exterior surface 8 of second end wall panel 22. Third inner end flap 46 (together with third outer end flap 50) is folded inwardly about fold line 43, bringing the interior surface 6 of third inner end flap 46 into face-contacting relationship with a corresponding portion of the exterior surface 8 of second end wall panel 22 and securing it thereto.

Glue or other adhesive treatment can be applied to the interior surface 6 of fourth inner end flap 48, or, alternatively, to a corresponding portion of the exterior surface 8 of first end wall panel 18. Fourth inner end flap 48 (together with fourth outer end flap 52) is folded inwardly about fold line 45, bringing the interior surface 6 of fourth inner end flap 44 into face-contacting relationship with a corresponding portion of the exterior surface 8 of first end wall panel 18 and securing it thereto.

Figure 6:
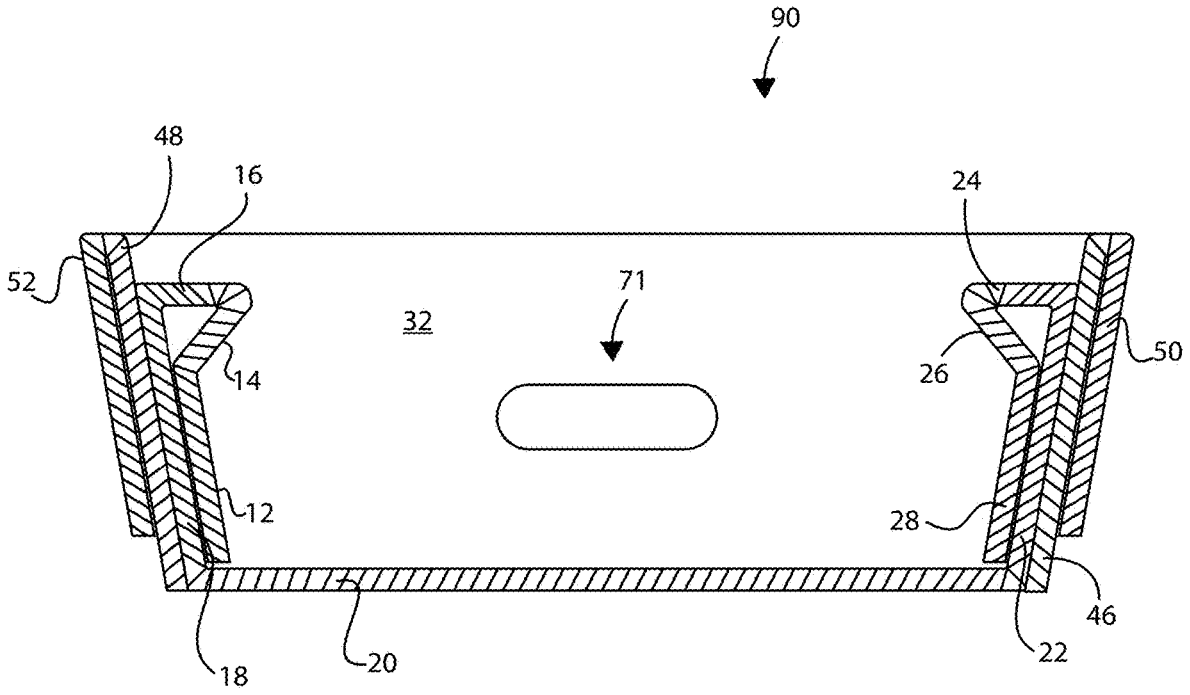
FIG. 6 is a cross-sectional side view of the container shown in FIG. 2 taken along the line A-A shown in FIG. 3.

The above-described steps result in the formation of the completed crate 90 as shown in FIG. 2. As best seen in FIG. 6, the configuration of the respective ledge panels 16, 24, angled support panels 14, 26, anchor panels 12, 28, and end wall panels 18, 22 form two inwardly-extending stacking ledges with support structures that have a triangular cross-section. In alternative embodiments, the support structures may have a cross-sectional shape that is other than triangular. In the illustrated first embodiment, each of the anchor panels 12, 28 is configured to extend from the corresponding angled support panel 14, 26 to a point at or adjacent to the crate's bottom wall. The ledge panels 16, 24 provide supporting surfaces for enabling a number of like crates to be stacked one on top of another while protecting their contents from crushing. Thus, the ledge panels 16, 24 are configured to receive and support a portion of the bottom wall of a like crate when two or more crates are stacked together.

As shown in FIG. 2, the upper edges of end flaps 38, 40, 42, 44, 46, 48, 50, 52 extend above the ledges formed by ledge panels 16, 24. The side and end walls of the crate are configured to taper slightly outward as they extend from the crate's bottom wall. Thus, the width of the crate (i.e., the distance between the first and second side walls) is slightly less at the bottom of the crate than at the top. Similarly, the length of the crate (i.e., the distance between the first and second end walls) is slightly less at the bottom of the crate than at the top. This configuration facilitates the ready stacking of multiple like crates.

Figure 7:
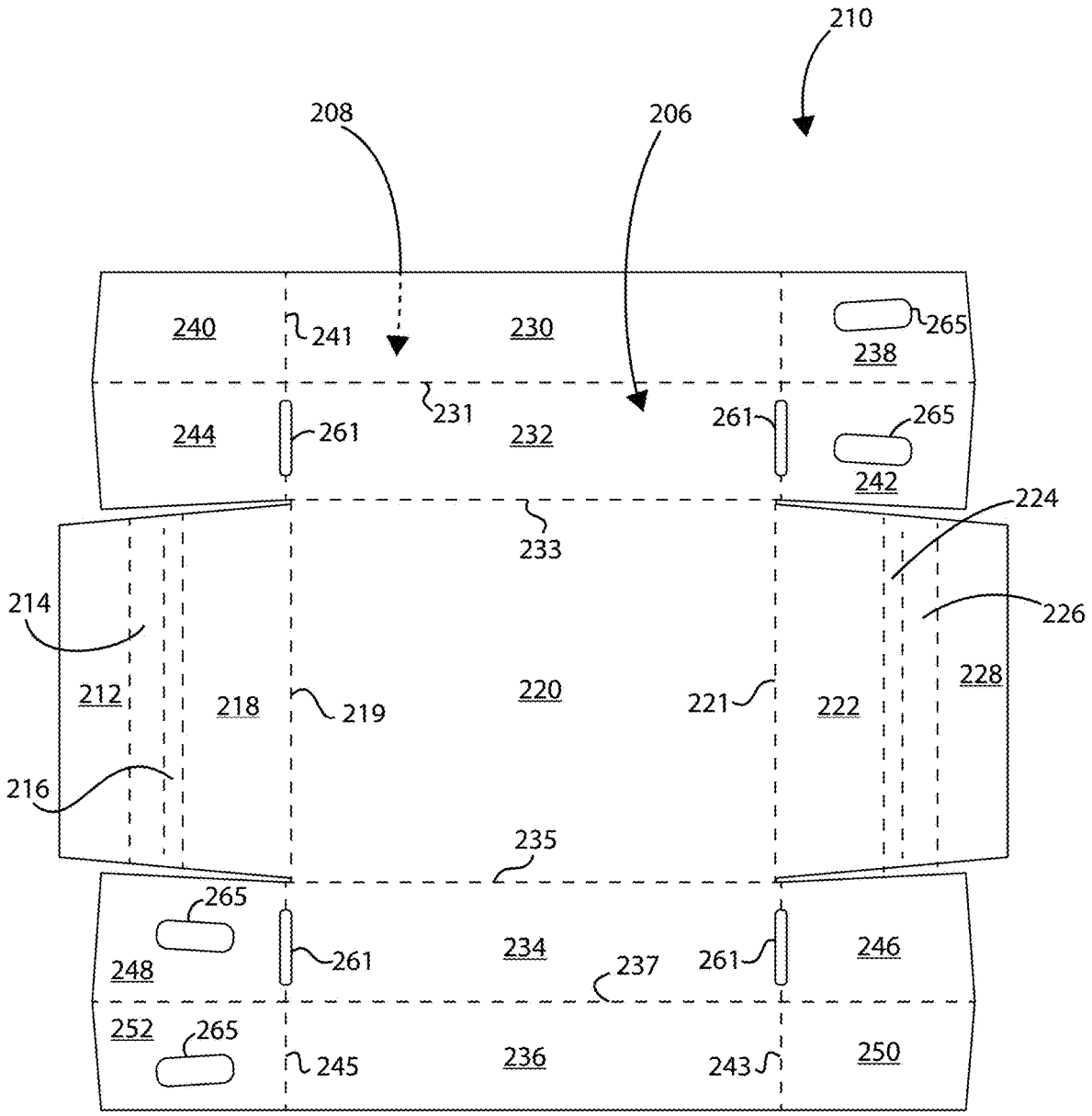
FIG. 7 is a top plan view of an exemplary blank of sheet material according to a second embodiment of the invention.
Figure 8:
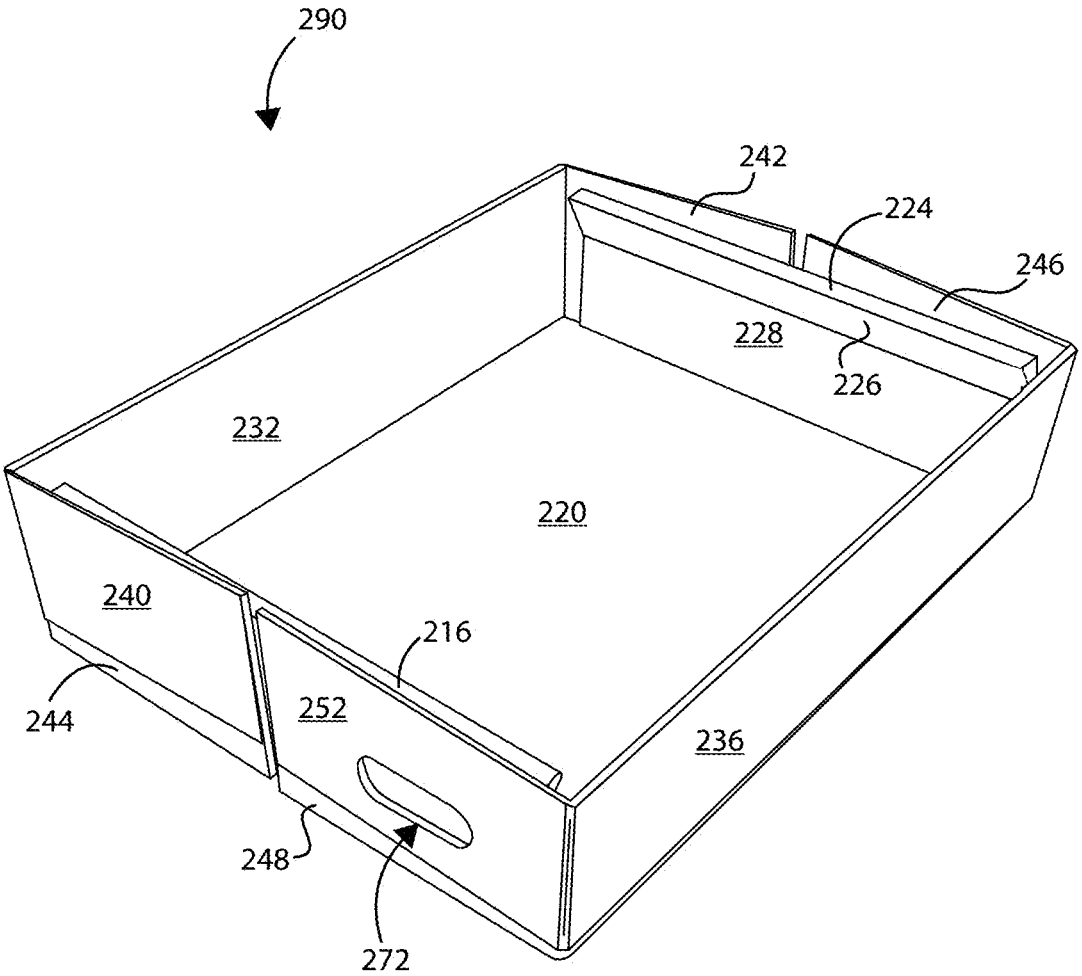
FIG. 8 is a perspective view of a container formed from the blank shown in FIG. 7.

FIG. 7 is a plan view of a blank 210 used to form a crate 290 (see FIG. 8) according to a second embodiment of the invention. Blank 210 and the corresponding crate 290 can be generally similar to the blank 10 and crate 90 discussed above, and like or similar reference numbers in the figures indicate like or similar elements. The primary differences between the first and second embodiments relate to the absence of side handle cutouts on side panels 230, 232, 234, 236 and the absence of end handle cutouts on end wall panels 218, 222 and anchor panels 212, 228. Blank 210 does, however, include end handle cutouts 265 on end flaps 238, 242 and 248, 252 which form handle structures 272 that do not pass entirely through the crate's end walls.

Figure 9:
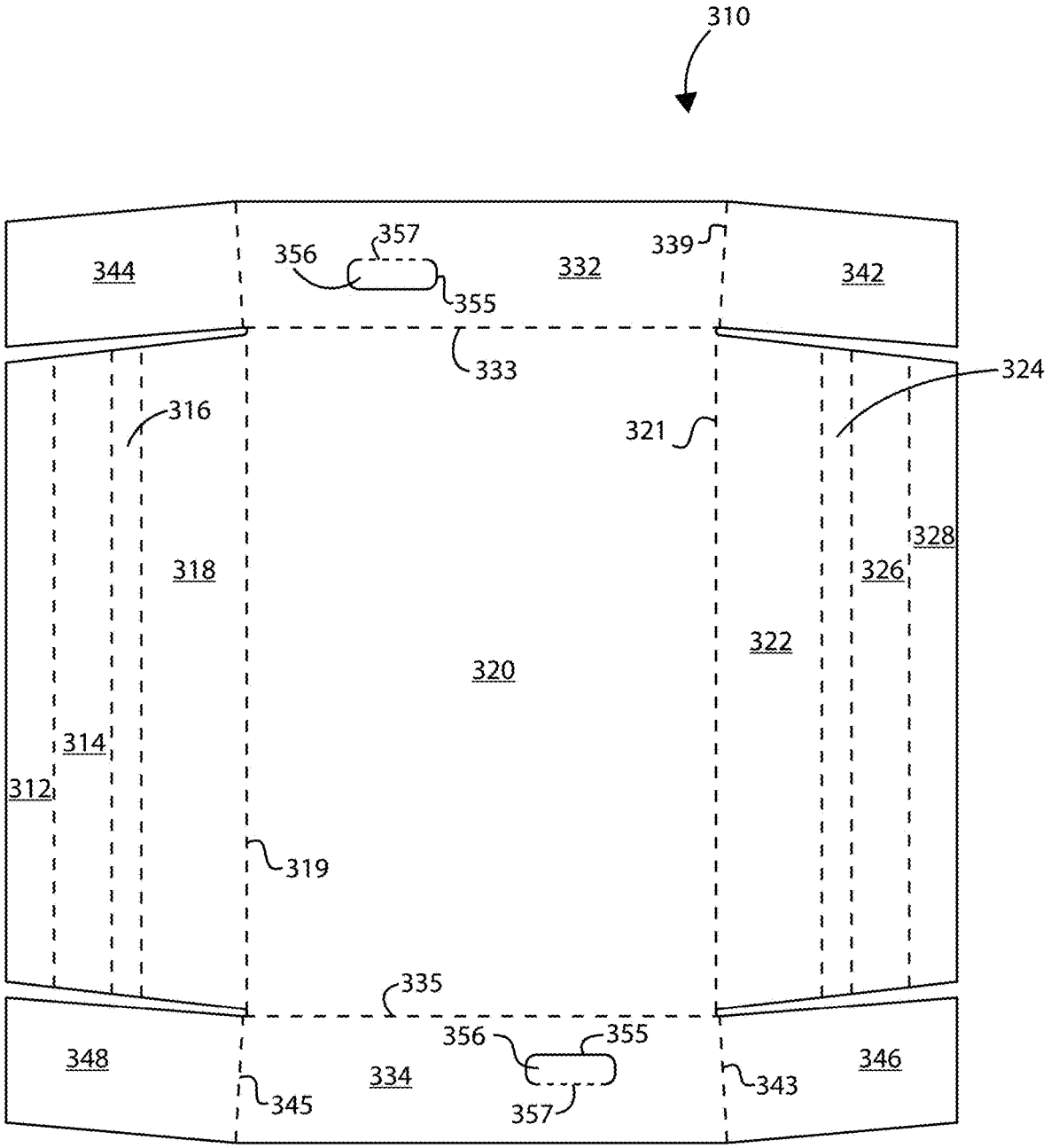
FIG. 9 is a top plan view of an exemplary blank of sheet material according to a third embodiment of the invention.
Figure 10:
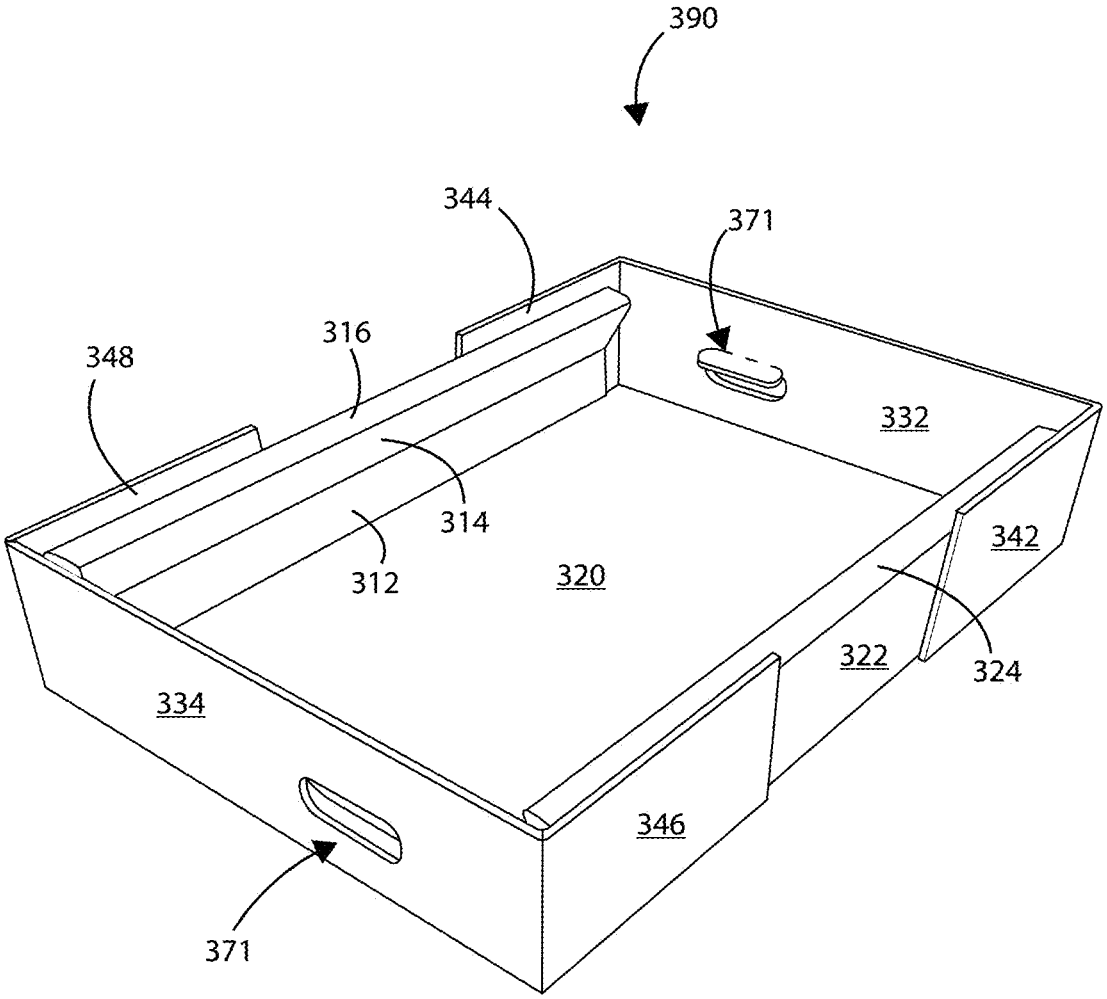
FIG. 10 is a perspective view of a container formed from the blank shown in FIG. 9.

FIG. 9 is a plan view of a blank 310 used to form a crate 390 (see FIG. 10) according to a third embodiment of the invention. Blank 310 and the corresponding crate 390 can be generally similar to the blank 10 and crate 90 discussed above, and like or similar reference numbers in the figures indicate like or similar elements. The primary difference between the first and third embodiments is that in the third embodiment, the end walls of crate 390 and thus the stacking ledges 316, 324 are disposed lengthwise. In other words, the distance between the opposed end walls from which the stacking ledges extend is less than the distance between the two opposed side walls. In addition, the side walls of crate 390 are each formed from only a single panel, i.e., first side panel 332 and second side panel 334 respectively. Thus, blank 310 only includes a single end flap (i.e., 342, 344, 346, and 348 respectively) at each of the blank's four corners. Finally, crate 390 does not include end handles but does include two side handles 371. Side handles 371 are provided by cut lines 355 in first and second side panels 332, 334 that form handle cushion flaps 356 that are hingedly connected to their respective side panels along fold lines 357.

Figure 11:
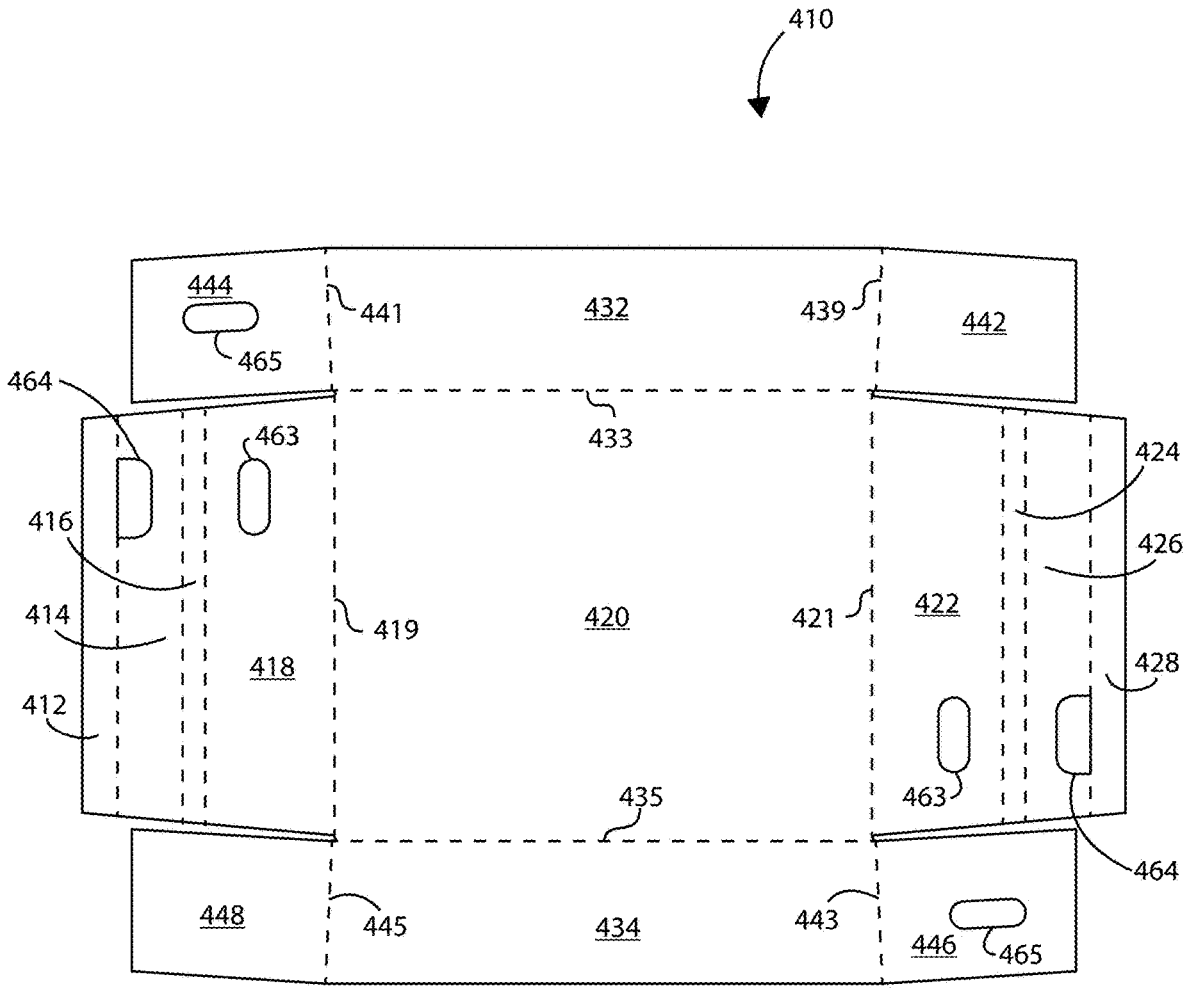
FIG. 11 is a top plan view of an exemplary blank of sheet material according to a fourth embodiment of the invention.
Figure 12:
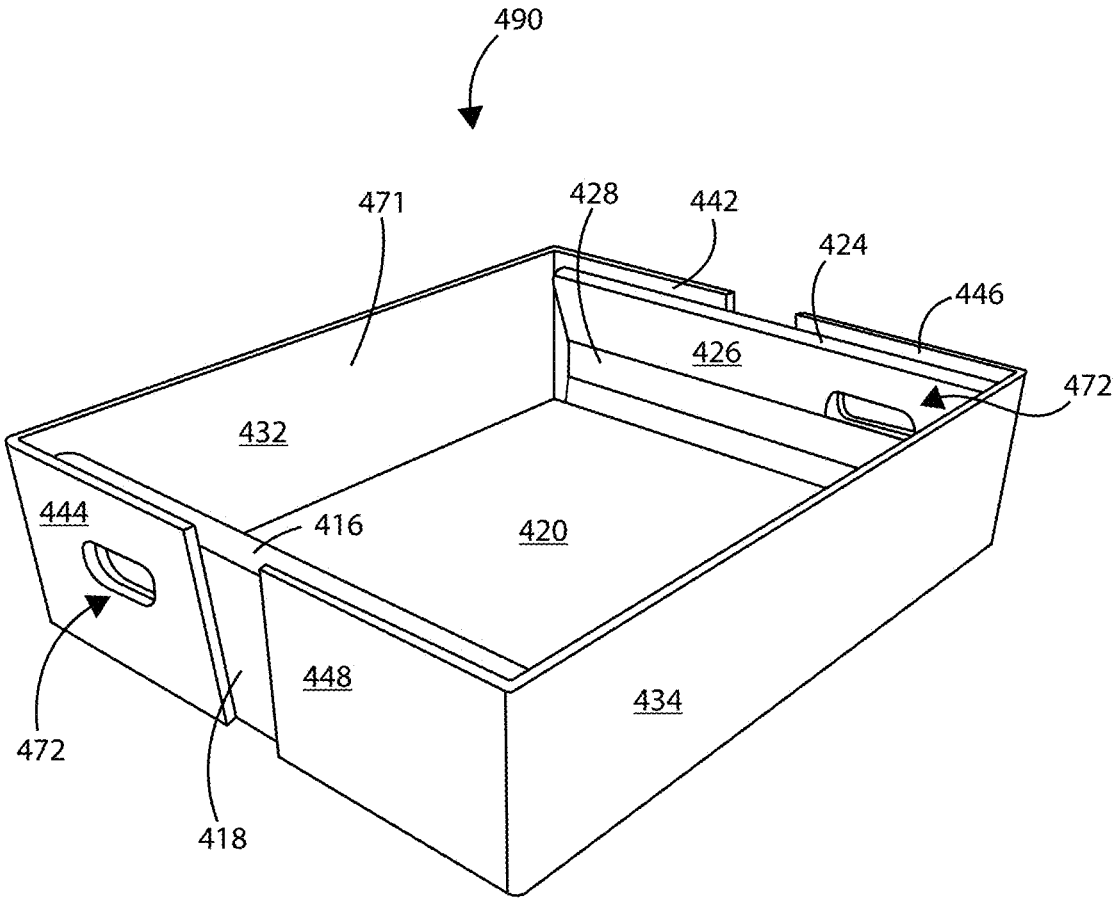
FIG. 12 is a perspective view of a container formed from the blank shown in FIG. 11.

FIG. 11 is a plan view of a blank 410 used to form a crate 490 (see FIG. 12) according to a fourth embodiment of the invention. Blank 410 and the corresponding crate 490 can be generally similar to the blank 10 and crate 90 discussed above, and like or similar reference numbers in the figures indicate like or similar elements. As in the third embodiment, the side walls of crate 490 are each formed from only a single panel, i.e., first side panel 432 and second side panel 434 respectively. Thus, blank 410 only includes a single end flap (i.e., 442, 444, 446, and 448 respectively) at each of the blank's four corners. In addition, crate 490 does not include side handles but does two include two end handles 472. End handles are each formed from three end handle cutouts 463, 464, and 465 that are configured to align with one another in the constructed crate 490. Unlike in the first embodiment, however, end handle cutouts 464 are formed in angled edge panels 414, 426 rather than in anchor panels 412, 428. In addition, unlike in the first embodiment, anchor panels 412, 428 are not configured to extend all the way to the crate's bottom wall.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container formed from a blank of sheet material, the container comprising:

a bottom wall having two opposing end edges and two opposing side edges extending between the end edges;

first and second end walls each comprising, in series:

an end wall panel extending upwardly from, and hingedly connected to, a corresponding one of the bottom wall end edges;

a ledge panel extending inwardly from, and hingedly connected to, an upper edge of the end wall panel;

an angled support panel extending diagonally from, and hingedly connected to, an end edge of the ledge panel and extending toward the end wall panel; and an anchor panel extending downwardly from, and hingedly connected to, a bottom edge of the angled support panel and disposed in facing contact with the end wall panel, wherein the ledge panel, angled support panel, and end wall panel form a triangular cross-section; and first and second side walls extending upwardly from respective bottom wall side edges, each of the first and second side walls comprising a first wrap-around end flap extending from a first side wall end edge and at least partly around said first end wall, and a second wrap-around end flap extending from a second side wall end edge and at least partly around said second end wall, wherein said first wrap-around end flap extends above the ledge panel of the first end wall, and wherein said second wrap-around end flap extends above the ledge panel of the second end wall.

2. The container of claim 1, wherein each of the first and second side walls comprises an inner side panel and an outer side panel secured in facing contact with one another.

3. The container of claim 2, wherein each of the first and second wrap-around end flaps comprises an inner end flap and an outer end flap secured in facing contact with one another, wherein said inner end flap extends from a side edge of said inner side panel and said outer end flap extends from a side edge of said outer side panel.

4. The container of claim 1, wherein at least one of the first and second wrap-around end flaps of at least one of the first and second side walls defines a first handle cutout.

5. The container of claim 4, wherein the end wall panel of at least one of the first and second end walls defines a second handle cutout, and wherein the anchor panel of the at least one of the first and second end walls defines a third handle cutout, and wherein said first, second, and third handle cutouts align with one another to form an end handle.

6. The container of claim 1, wherein the anchor panel is configured to extend from the angled support panel to at a point that is at or adjacent to the bottom wall.

7. The container of claim 1, wherein the ledge panel is substantially perpendicular to the end wall panel.

8. The container of claim 1, wherein each of the first and second end walls comprises a handle that does not extend completely through the respective end wall.

9. A blank for forming a container, the blank comprising:

a bottom wall panel having two opposing end edges and two opposing side edges extending between the end edges, the bottom wall panel being configured to form a bottom wall in a set-up container;

a first plurality of panels configured to form a first end wall in the set-up container, the first plurality of panels being hingedly connected to one another and comprising, in series:

a first end wall panel hingedly connected to the bottom wall panel at a first of the opposing end edges, the first end wall panel being configured to extend upwardly from the first of the opposing end edges in the set-up container;

a first ledge panel hingedly connected to, and configured to extend inwardly from, an upper edge of the first end wall panel in the set-up container and thereby form a first stacking ledge;

a first angled support panel hingedly connected to, and configured to extend diagonally from, an end edge of the first ledge panel, and to extend toward the first end wall panel in the set-up container; and a first anchor panel hingedly connected to, and configured to extend downwardly from, a bottom edge of the first angled support panel and be positioned in facing contact with an interior surface of the first end wall panel in the set-up container, wherein the first ledge panel, first angled support panel, and first end wall panel form a triangular cross-section in the set-up container;

a first side wall panel configured to form a first side wall in the set-up container and a second side wall panel configured to form a second opposed side wall in the set-up container, the first side wall panel being hingedly connected to the bottom wall panel at a first of said two opposing side edges and said second side wall panel being hingedly connected to the bottom wall panel at a second of said opposing side edges;

a first wrap-around end flap extending from a first end edge of said first side wall panel, said first wrap-around end flap being configured to extend at least partly around the first end wall in the set-up container; and a second wrap-around end flap extending from a first end edge of said second side wall panel, said second wrap-around end flap being configured to extend at least partly around the first end wall in the set-up container;

wherein the first and second wrap-around end flaps are configured to extend above the first stacking ledge in the set-up container.

10. The blank according to claim 9, wherein the blank further comprises:

a second plurality of panels configured to form a second end wall in the set-up container, the second plurality of panels being hingedly connected to one another and comprising, in series:

a second end wall panel hingedly connected to the bottom wall panel at a second of the opposing end edges, the second end wall panel being configured to extend upwardly from the second of the opposing end edges in the set-up container;

a second ledge panel configured to extend inwardly from an upper edge of the second end wall panel in the set-up container and thereby form a second stacking ledge;

a second angled support panel configured to extend diagonally toward the second end wall panel in the set-up container; and a second anchor panel configured to be positioned in facing contact with an interior surface of the second end wall panel in the set-up container, wherein the second ledge panel, second angled support panel, and second end wall panel form a triangular cross-section in the set-up container;

a third wrap-around end flap extending from a second end edge of said first side wall panel, said third wrap-around end flap being configured to extend at least partly around the second end wall in the set-up container; and a fourth wrap-around end flap extending from a second end edge of said second side wall panel, said second wrap-around end flap being configured to extend at least partly around the second end wall in the set-up container;

wherein the third and fourth wrap-around end flaps are configured to extend above the second stacking ledge in the set-up container.

* * * * *